US006854530B1

(12) United States Patent
Yiu

(10) Patent No.: US 6,854,530 B1
(45) Date of Patent: Feb. 15, 2005

(54) METHOD FOR DRIVING ELECTRIC PERCUSSION TOOL

(76) Inventor: Chih Hao Yiu, 6F-2, No. 160, Sec. 1, Jhonggang Road, West District, Taichung (TW), 403

( * ) Notice: Subject to any disclaimer, the term of this patent is extended or adjusted under 35 U.S.C. 154(b) by 0 days.

(21) Appl. No.: 10/654,548

(22) Filed: Sep. 1, 2003

(51) Int. Cl.[7] ..... B25D 11/06
(52) U.S. Cl. ..... 173/1; 173/117; 173/131
(58) Field of Search ..... 173/1, 19, 51, 173/52, 114, 117, 118, 121; 227/131, 132; 310/12–39; 335/251, 261, 265

(56) References Cited

U.S. PATENT DOCUMENTS

| | | | | | |
|---|---|---|---|---|---|
| 3,054,464 | A | | 9/1962 | Ondeck | |
| 3,308,892 | A | | 3/1967 | Palmer | |
| 3,434,026 | A | * | 3/1969 | Doyle | 318/125 |
| 3,811,313 | A | | 5/1974 | Schut | 72/430 |
| 3,924,789 | A | * | 12/1975 | Averye et al. | 227/131 |
| 3,940,726 | A | * | 2/1976 | Gershnow | 335/274 |
| 4,215,297 | A | | 7/1980 | Jacquemet | 318/130 |
| 4,565,313 | A | * | 1/1986 | Buck et al. | 227/131 |
| 4,836,008 | A | * | 6/1989 | Weber | 29/243.521 |
| 4,928,868 | A | * | 5/1990 | Kerrigan | 227/131 |
| 5,760,552 | A | | 6/1998 | Chen et al. | 318/122 |
| 6,364,193 | B1 | * | 4/2002 | Tsai | 227/131 |
| 6,724,286 | B2 | * | 4/2004 | Arnold et al. | 335/273 |
| 2002/0014344 | A1 | | 2/2002 | Geiger et al. | |

* cited by examiner

*Primary Examiner*—Eugene Kim
*Assistant Examiner*—Paul Durand
(74) *Attorney, Agent, or Firm*—Charles E. Baxley

(57) ABSTRACT

A method for driving an electric percussion tool which includes a solenoid, a plunger core partially engaged in one end of the solenoid, and a spring disposed out of the solenoid and closer to the other end of the solenoid and distal to the plunger core. The solenoid is energized to draw the plunger core from one end to the middle of the solenoid, and selectively de-energized to allow the plunger core to force against the spring member. The solenoid is energized and de-energized again to move the plunger core toward the middle portion and then to move in the driving direction in addition to the spring biasing force applied by the spring member.

4 Claims, 6 Drawing Sheets

METHOD FOR DRIVING ELECTRIC PERCUSSION TOOL

BACKGROUND OF THE INVENTION

1. Field of the Invention

The present invention relates to a method for driving tools, and more particularly to a method for driving electric hammer or impact or percussion tools 2. Description of the Prior Art Various kinds of typical electric percussion tools, impact beating tools, or the like have been developed and provided for hammering or stapling or nailing purposes, and comprise a plunger core slidably received in a coil or solenoid, which may actuate or force the plunger core to move and thus to hammer or impact onto objects.

For example, U.S. Pat. No. 3,308,892 to Palmer, and U.S. Pat. No. 4,215,297 to Jacquemet disclose two of the typical electric percussion tools, impact beating tools, or the like and comprise a single plunger core slidably received in a single solenoid, and a spring member for recovering the plunger core back to the original position, or away from the middle portion of the solenoid.

In operation, the plunger core may be forced to move toward the middle portion of the solenoid every time when the solenoid is energized. The spring member is provided for recovering or moving the plunger core away from the middle portion of the solenoid after every striking or hammering operation, for allowing the solenoid to actuate or move the plunger core next time.

However, the striking or hammering forces of the plunger core is small or less, such that the plunger core has to be forced or actuated many times, in order to conduct the striking or hammering operation many times.

In order to improve the small striking or hammering problems, another typical electric percussion tool has been developed to provide a ram propelled device to produce high impact forces against the work pieces. U.S. Pat. No. 3,811,313 to Schut discloses one of the typical impact devices. However, a complicated configuration and a number of members or elements are required to be provided to form the electromagnetic high energy pulse coil and the ram propelled device.

U.S. Pat. No. 3,054,464 to Ondeck, and U.S. Pat. No. 5,760,552 to Chen, et al., and U.S. Pat. No. 6,364,193 to Tsai disclose the other typical electric percussion tools, impact beating tools, or the like and comprise a plunger core slidably received in two or more solenoids which may be actuated in series to actuate the plunger core to impact onto the objects.

However, a large space is required to receive the two or more solenoids, such that the volume of the tools may be greatly increased.

U.S. Patent Application No. US2002/0014344A1 to Geiger et al. discloses a further typical electric percussion tool which includes two coils or solenoids having an axis disposed or extended transverse to the oscillation axis of a working tool. Similarly, a complicated configuration and a number of members or elements are required to be provided to form and to arrange the electromagnetic hammer and a yoke thereof.

In all of the typical electric percussion tools, the spring members are all provided for recovering the plunger core only, and may not be used to force the plunger core while conducting the striking or hammering operations.

The present invention has arisen to mitigate and/or obviate the afore-described disadvantages of the conventional methods for driving electric percussion tools.

SUMMARY OF THE INVENTION

The primary objective of the present invention is to provide a method for driving electric percussion tool and for allowing the spring member to apply a moving or driving force against the plunger core, in addition to a solenoid, while conducting the striking or hammering operations.

In accordance with one aspect of the invention, there is provided a method for driving an electric percussion tool, comprising actuating a solenoid to act onto a plunger core, and actuating a spring member to apply a spring biasing force onto the plunger core in addition to the solenoid.

In accordance with the other aspect of the invention, there is provided a method for driving an electric percussion tool, the electric percussion tool including a solenoid having a first end and a second end and a middle portion, a plunger core partially engaged in the first end of the solenoid, and a spring disposed out of the solenoid and closer to the second end of the solenoid, and distal to the first end of the solenoid and the plunger core. The method comprises energizing the solenoid to draw the plunger core from the first end of the solenoid toward the middle portion of the solenoid, de-energizing the solenoid, to allow the plunger core to move from the middle portion of the solenoid toward the second end of the solenoid with a moment of inertia of the plunger core, and to allow the plunger core to move and force against the spring member, energizing the solenoid again to draw the plunger core from the second end of the solenoid toward the middle portion of the solenoid, and de-energizing the solenoid again, to allow the plunger core to move from the middle portion of the solenoid toward the first end of the solenoid with a moment of inertia of the plunger core.

The spring member may apply a spring biasing force against the plunger core to force the plunger core to move from the second end of the solenoid toward the first end of the solenoid, in addition to the solenoid, and thus to allow the plunger core to be forced or actuated by both the electromagnetic action of the solenoid and the spring biasing force of the spring member.

The spring member is preferably spaced away from the solenoid to allow the plunger core to move outwardly beyond the second end of the solenoid when the plunger core is forced against the spring member.

The solenoid is energized again to draw the plunger core from the second end of the solenoid toward the middle portion of the solenoid when the plunger core is forced to move partially into the second end of the solenoid by the spring member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
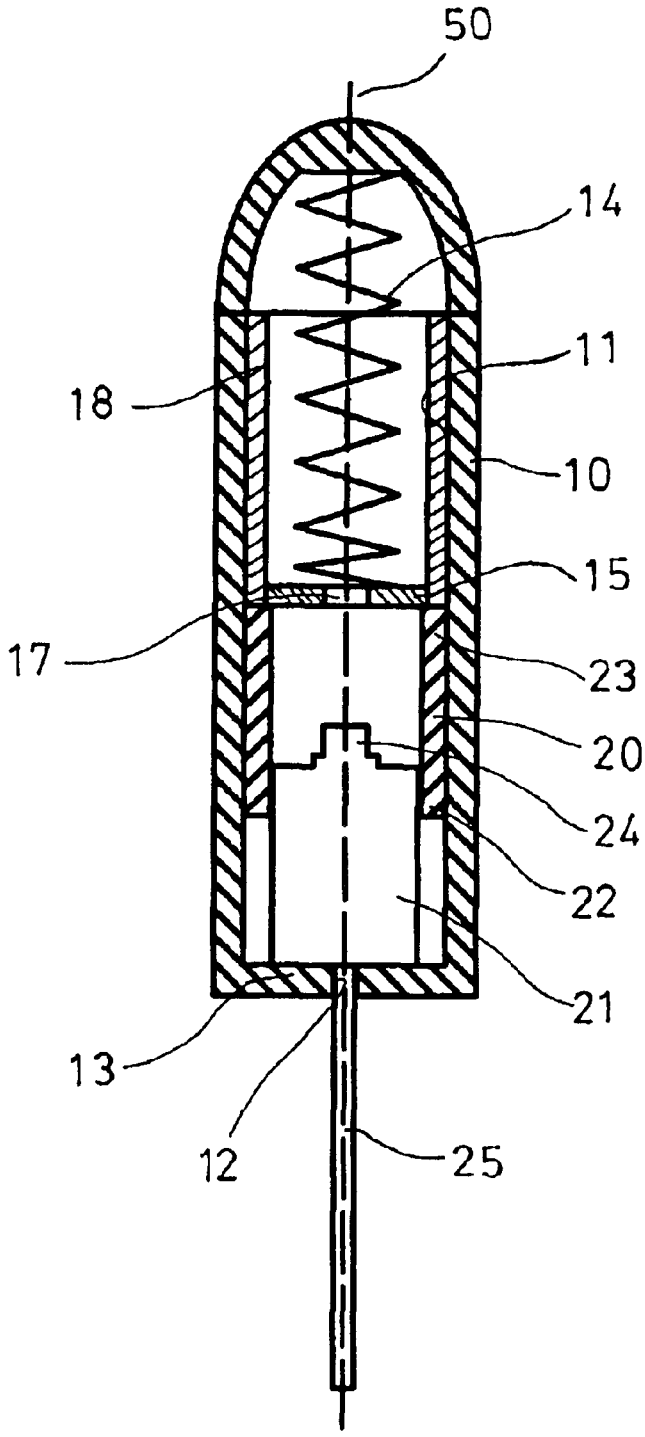
FIG. 1 is a cross sectional schematic view of an electric percussion tool to be operated or actuated with a method in accordance with the present invention.

Referring to the drawings, and initially to FIG. 1 an electric percussion tool to be driven or operated by a method in accordance with the present invention comprises a housing 10 including a chamber 11 formed therein, and including an opening 12 formed in one end thereof and defined by an end wall 13 and communicating with the chamber 11 thereof.

A spring member 14 is disposed in the chamber 11 of the housing 10 and disposed in the other end of the housing 10 or arranged or disposed distal to the opening 12 of the housing 10. A plate 15 is attached to an inner end or a free end of the spring member 14 and movable along the chamber 11 of the housing 10, and includes a cavity 17 formed therein.

A coil or solenoid 20 is disposed in the middle portion of the chamber 11 of the housing 10, and a plunger core 21 is slidably received in the solenoid 20. The plunger core 21 is arranged to be partially movable out of one end 22 of the solenoid 20, but may not be completely or fully moved out of the one end 22 of the solenoid 20. The spring member 14 is disposed out of the solenoid 20 and distal to the plunger core 21.

The plunger core 21 is arranged to be completely or fully movable out of the other end 23 of the solenoid 20 (FIGS. 4, 5), when required. The plunger core 21 includes a projection 24 extended from one end thereof to engage into the cavity 17 of the plate 15, for allowing the plunger core 21 to suitably force against the spring member 14.

It is preferable that the housing 10 further includes a barrel 18 engaged in the chamber 11 thereof, and disposed around the spring member 14, and includes an inner diameter no greater than that of the solenoid 20, for suitably guiding the plate 15 and the plunger core 21 to slide along the chamber 11 of the housing 10 or along an oscillation axis 50 of the housing 10 or of the percussion tool, and to prevent the plunger core 21 from tilting relative to the housing 10.

The barrel 18 is preferably made of non-conductive or non-electromagnetic materials, for preventing the barrel 18 to interfere the energizing or the operation of the solenoid 20 and the plunger core 21. The plunger core 21 includes a shank 25 extended therefrom and extendible out through the opening 12 of the housing 10, for hitting or hammering or impacting onto objects.

It is to be noted that the electric percussion tool as shown in FIG. 1 is simplified for illustration purposes. The examples of the electric percussion tools have been disclosed and described in the cited arts, which may thus be taken as references for the present invention. The electric percussion tool may be used for nailing or stapling or hammering purposes.

Figure 2:
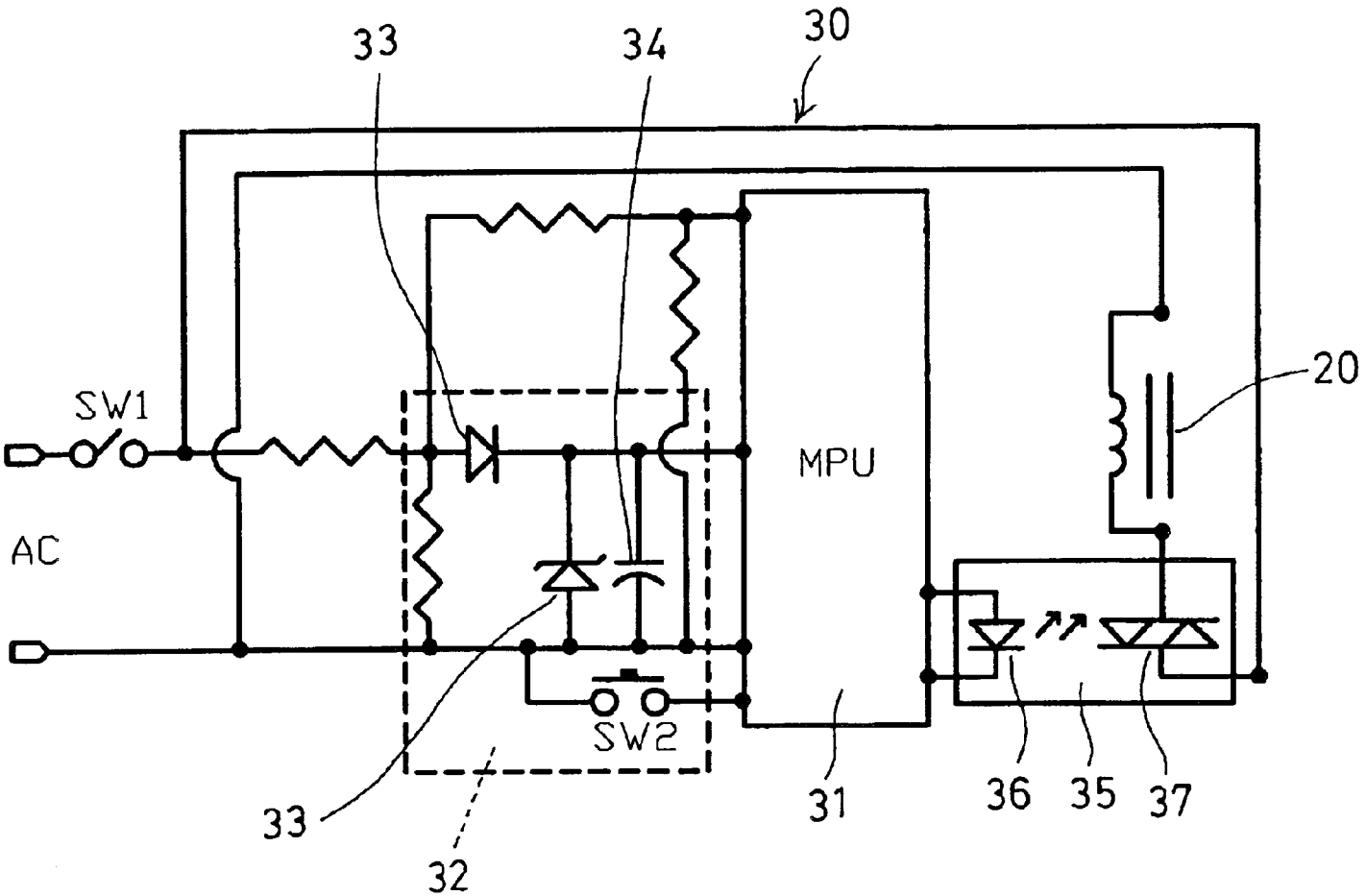
FIG. 2 is a plan schematic view illustrating an actuating electric circuit for driving or actuating or operating the electric percussion tool.

Referring next to FIG. 2, illustrated is one example of an actuating electric circuit 30 for driving or actuating or operating the electric percussion tool as shown in FIG. 1. The actuating electric circuit 30 includes a microprocessor unit (MPU) 31 for programming or processing purposes, and/or for controlling the operation of the electric percussion tool.

The actuating electric circuit 30 includes a power circuit 32 having one or more diodes 33 and one or more capacitors 34 for providing stabilized electric power to energize the MPU 31 or the other electric parts or elements which will be described hereinafter. The actuating electric circuit 30 further includes an actuating device 35 having a photodiode 36 coupled to the MPU 31, for being actuated or operated by the MPU 31.

The actuating device 35 includes an actuating member 37, such as a triode AC switch or triggering bi-directional thyristor (TRIAC) 37 coupled to the solenoid 20, and arranged to be actuated or operated by the MPU 31 via the photodiode 36, in order to actuate or to energize the solenoid 20, and in order to actuate the plunger core 21 to move relative to the solenoid 20.

Figure 3:
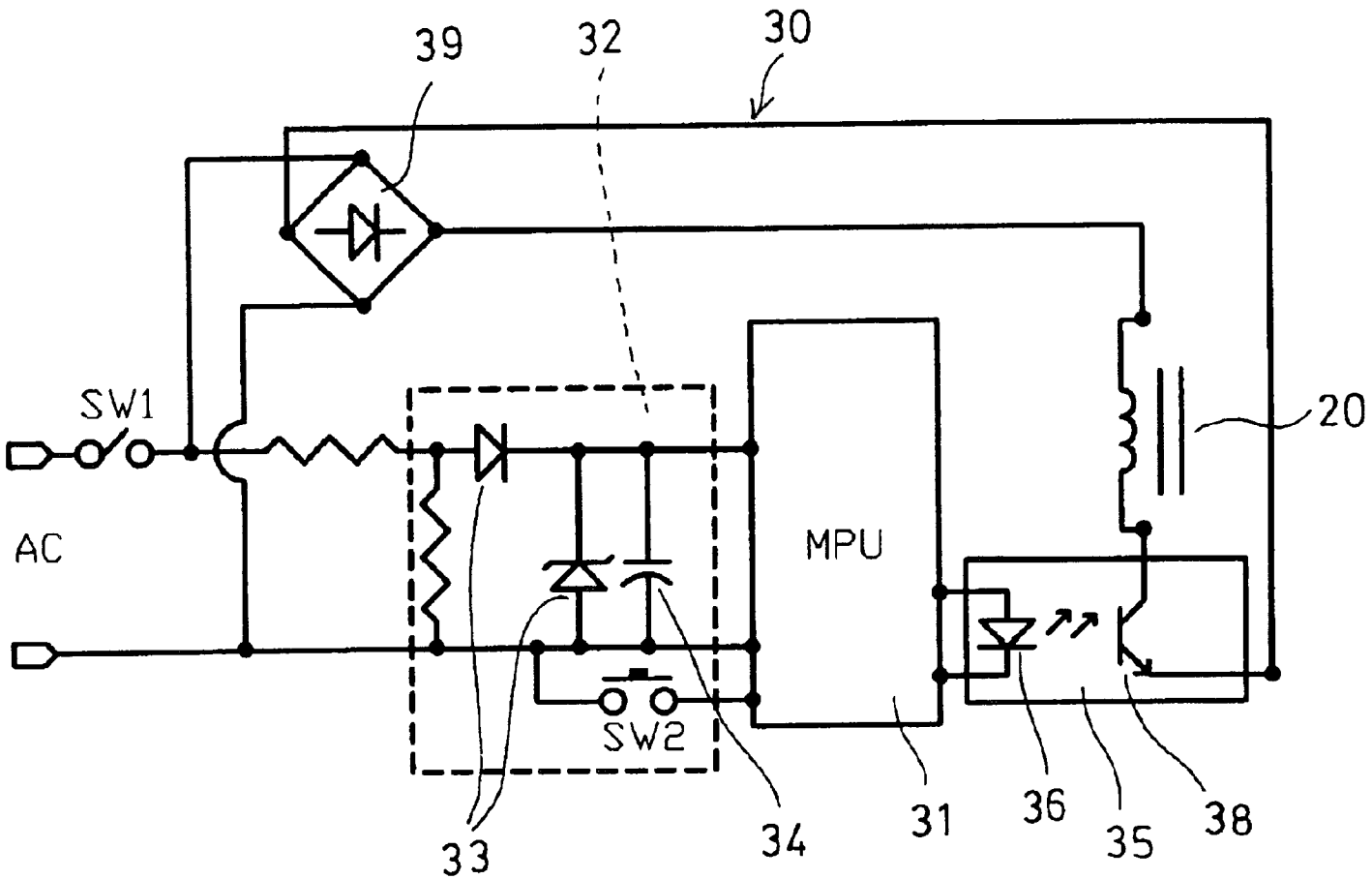
FIG. 3 is a plan schematic view similar to FIG. 2, illustrating another electric circuit for driving or actuating or operating the electric percussion tool.

As shown in FIG. 3, alternatively, a transistor 38 and a bridge rectifier circuit 39 may further be provided and coupled to the solenoid 20, instead of the TRIAC 37, and also arranged to be actuated or operated by the MPU 31 via the photodiode 36, in order to actuate or to energize the solenoid 20 and to actuate the plunger core 21 to move relative to the solenoid 20.

Figure 4:
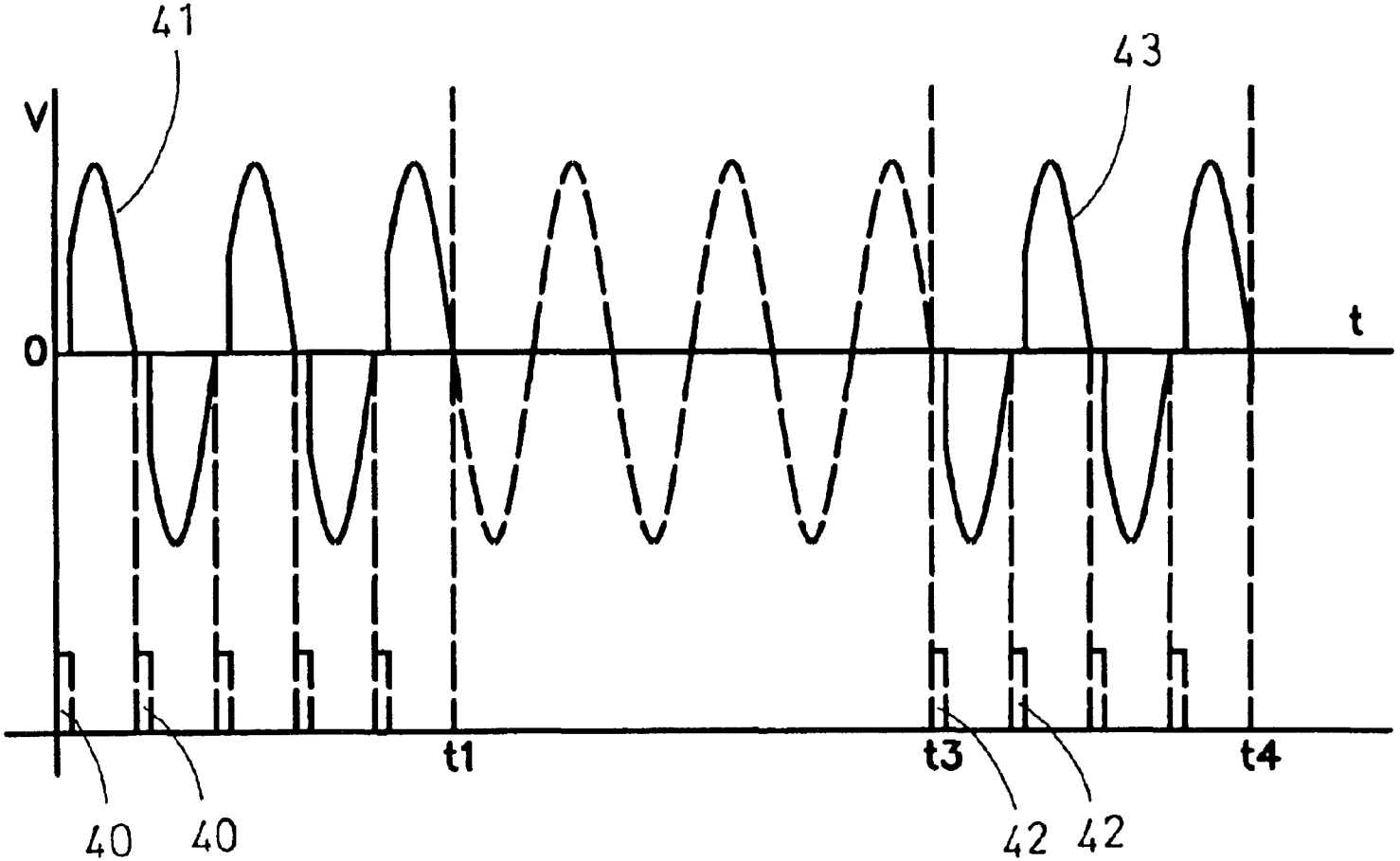
FIG. 4 is a schematic view illustrating the driving signals for actuating the solenoid of the electric percussion tool.

Referring next to FIG. 4, illustrated is one example of the pulse triggering signals 40, 42 for triggering the TRIAC 37 to actuate or to energize the solenoid 20 of the electric percussion tool. For example, during a time period 0–t1, one or more pulse triggering signals 40 may be generated by the MPU 31 via the photodiode 36, in order to turn on or to actuate the TRIAC 37 to supply sinuous driving signals 41 to actuate the solenoid 20 to move the plunger core 21 relative to the solenoid 20.

Similarly, during the other time period t2–t3, one or more pulse triggering signals 42 may be generated by the MPU 31 via the photodiode 36, in order to actuate the TRIAC 37 to supply sinuous driving signals 43 to actuate the solenoid 20 to move the plunger core 21 relative to the solenoid 20. In another time period t1–t2, no sinuous driving signals will be supplied to actuate the solenoid 20 when no pulse triggering signals have been generated and supplied by the MPU 31 and the photodiode 36.

It is to be noted that the sinuous driving signals 41, 43 having either positive or negative voltage may all be used to actuate or to operate the solenoid 20 to move the plunger core 21 relative to the solenoid 20. In addition, whenever the solenoid 20 is energized or actuated by either positive or negative voltage of the sinuous driving signals 41, 43, the plunger core 21 may all be forced to move toward the middle portion of or within the solenoid 20, which will be described in further details hereinafter.

Figure 5:
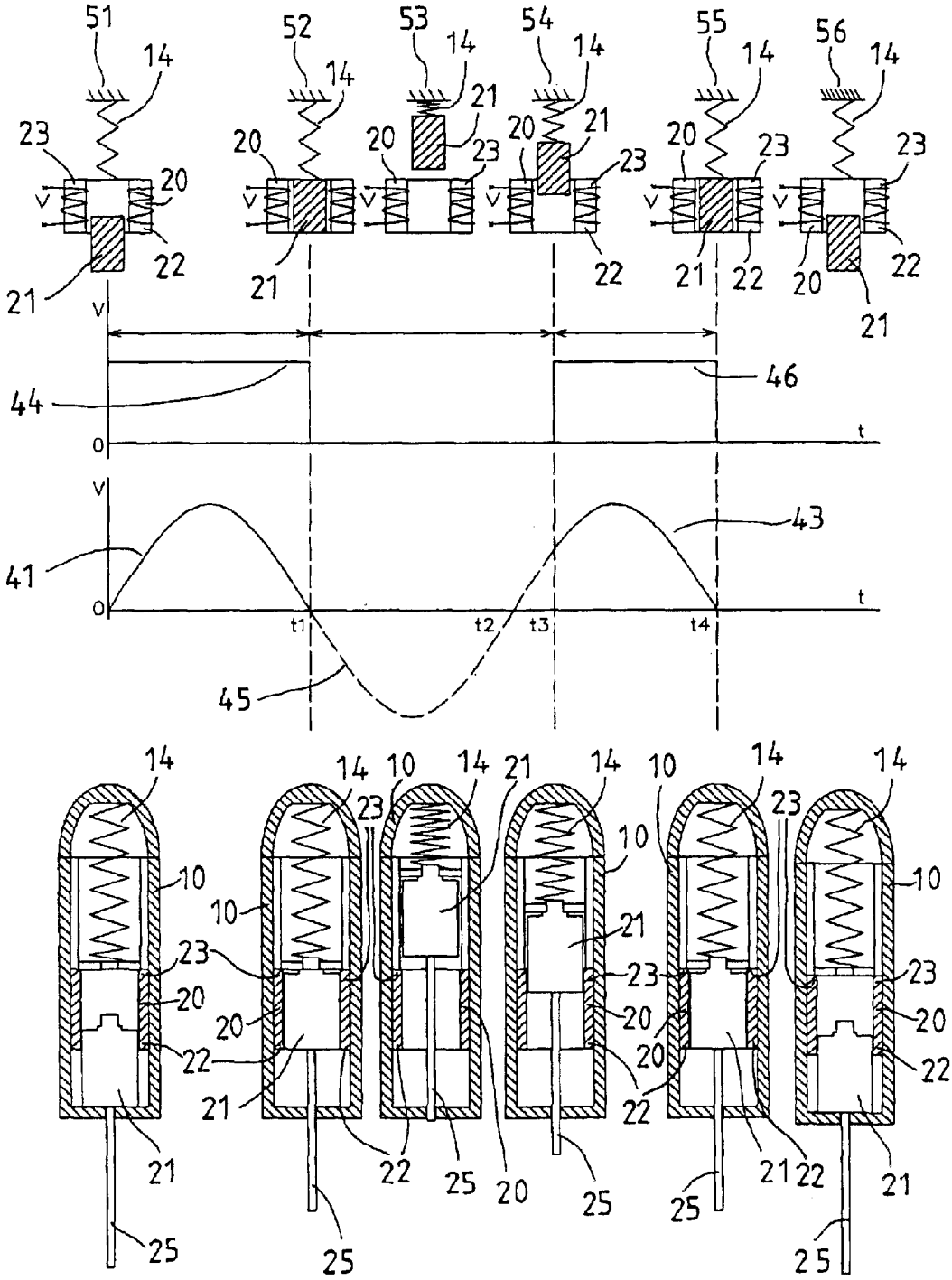
FIG. 5 is a schematic view illustrating the procedures for driving or actuating or operating the electric percussion tool.

Referring next to FIG. 5, illustrated is one example of a method or the procedures in accordance with the present invention for driving or actuating or operating the electric percussion tool. At the beginning, or at the time "0", the plunger core 21 is arranged to be partially extended out of the one end 22 of the solenoid 20, but not completely or fully moved out of the one end 22 of the solenoid 20, as shown in the position indicated by "51".

A positive voltage pulse signal 44 or a sinuous driving signal 41 will then be supplied by the actuating device 35, and controlled by the MPU 31, to energize or to actuate the solenoid 20 to force or to move or to draw the plunger core 21 along the oscillation axis 50 of the housing 10 (FIG. 1) or of the percussion tool, and in the direction toward the middle portion or the other end 23 of the solenoid 20, until the plunger core 21 is moved to the middle portion of the solenoid 20, as shown in the position indicated by "52", at the time t1.

When the plunger core 21 is moved to the middle portion of the solenoid 20 at position "52", the TRIAC 37 may be stopped or turned off or switched off automatically, such that no actuating signals will be sent to the solenoid 20 at this moment, and such that the solenoid 20 will be switched off or disabled at this moment.

At this time, the plunger core 21 has a tendency or has a moment of inertia to move away from the middle portion of the solenoid 20, and to move toward the other end 23 of the solenoid 20, and to move or force against the spring member 14. It is preferable that the spring member 14 is arranged to allow the plunger core 21 to move outwardly beyond the other end 23 of the solenoid 20, as shown in the position indicated by "53".

For example, the spring member 14 may be disposed on the other end of the housing 10 and coupled to the plunger core 21 to apply a pulling force against the plunger core 21, and to allow the plunger core 21 to move outwardly beyond the other end 23 of the solenoid 20. At this moment or at this position, the plunger core 21 is moved outwardly beyond the solenoid 20 and may not be actuated by the solenoid 20.

The spring member 14 may then force or bias the plunger core 21 to move toward the solenoid 20, until the plunger core 21 is partially moved into the other end 23 of the solenoid 20, as shown in the position indicated by "54", at the time t3. At this moment or at this position, the plunger core 21 may be actuated by the solenoid 20 again.

Before the plunger core 21 is partially moved into the other end 23 of the solenoid 20 at the time t3, it is preferable that the plunger core 21 is arranged to just reach the other end 23 of the solenoid 20, but not entering or moving into the other end 23 of the solenoid 20 yet, at time "t2", where the negative signal portion 45 of the sinuous driving signal ends.

However, alternatively, the spring member 14 may also be arranged to allow the plunger core 21 to be partially received within the other end 23 of the solenoid 20 only, and to prevent the plunger core 21 from been completely moved out beyond the other end 23 of the solenoid 20.

Once or when the plunger core 21 is partially moved into the other end 23 of the solenoid 20 at position "54", the solenoid 20 is energized or actuated again by the positive voltage pulse signal 46 or the sinuous driving signal 43 that may be supplied to the solenoid 20 by the TRIAC 37 of the actuating device 35 and controlled by the MPU 31.

At this moment, the plunger core 21 may be actuated or drawn by the solenoid 20 to move along the oscillation axis 50 of the housing 10 (FIG. 1) or of the percussion tool, and in the driving or acting direction toward the middle portion or the one end 22 of the solenoid 20, until the plunger core 21 is moved to the middle portion of the solenoid 20, as shown in the position indicated by "55", at the time t4.

When the plunger core 21 is moved to the middle portion of the solenoid 20 at position "55", the TRIAC 37 may be stopped or turned off or switched off automatically, such that no actuating signals will be sent to the solenoid 20 at this moment, and such that the solenoid 20 will be switched off or disabled at this moment.

At this time, the plunger core 21 that has been actuated by the solenoid 20 has a tendency or has a moment of inertia to move away from the middle portion of the solenoid 20, and to move in the driving or acting direction and toward the one end 22 of the solenoid 20. Simultaneously, or at this moment or at this position, the plunger core 21 may also be forced to move in the driving or acting, direction toward the one end 22 of the solenoid 20, from the other end 23 of the solenoid 20, by the spring member 14, in addition to the electromagnetic action by the solenoid 20, such that the shank 25 of the plunger core 21 may be forced to impact or to hit or to hammer onto the objects by both the electromagnetic action of the solenoid 20 and the spring biasing force of the spring member 14.

Figure 6:
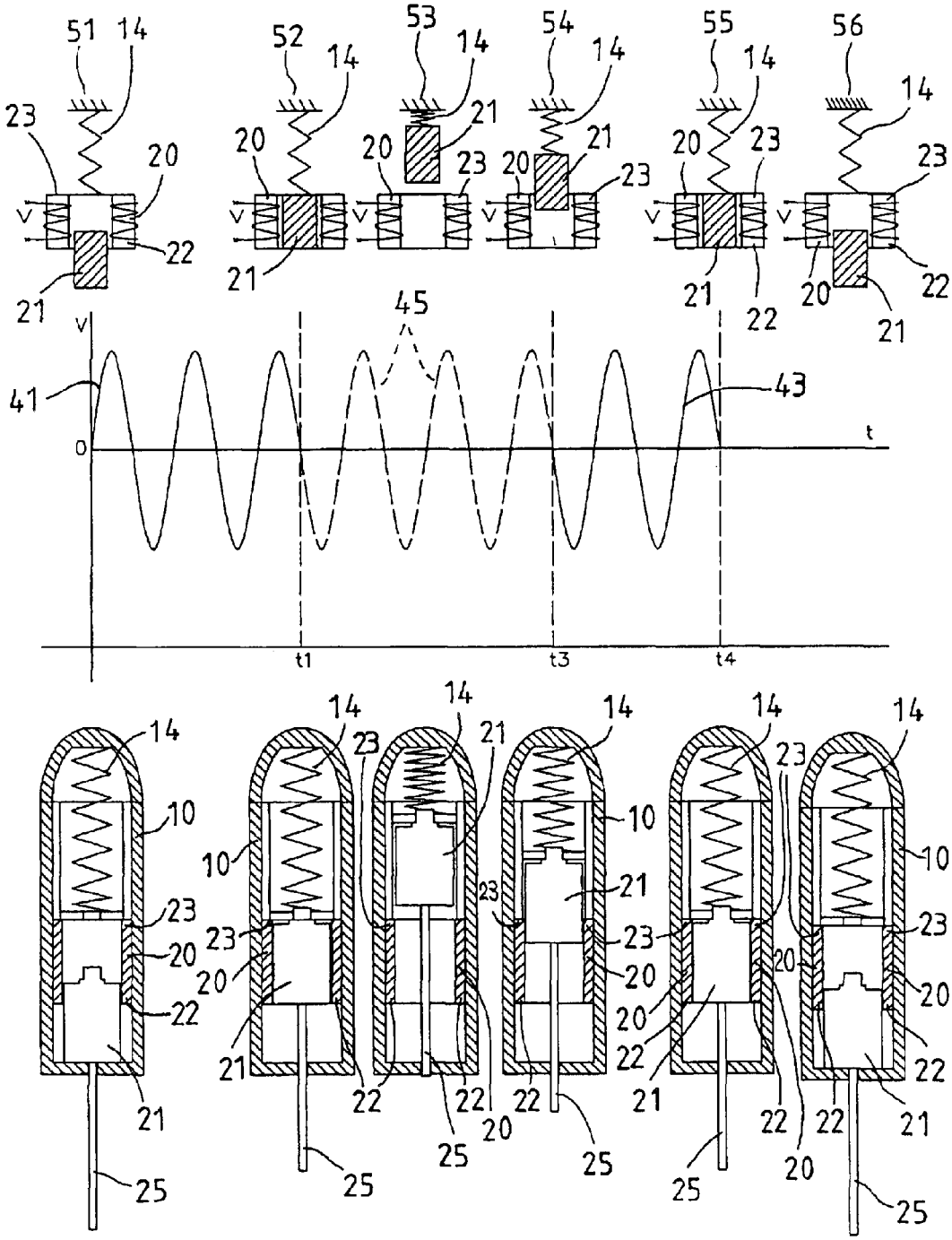
FIG. 6 is a schematic view similar to FIG. 5, illustrating the procedures for driving or actuating or operating the electric percussion tool with different actuating signals.

Referring next to FIG. 6, the solenoid 20 may be actuated by one or more positive and/or negative voltage portions of the sinuous driving signals 41, 43, in order to draw the plunger core 21, from either end of the solenoid 20 (position 51 or 54), to the middle portion of the solenoid 20 (position 52 or 55).

It is to be noted that the electric percussion tool includes a single solenoid 20 to drive or actuate the plunger core 21, and the spring member 14 may be arranged to be compressed by the plunger core 21 and to accumulate a spring biasing force to force the plunger core 21 to move in the driving or acting direction toward the one end 22 of the solenoid 20 in addition to the electromagnetic action by the solenoid 20.

The spring member 14 may also be arranged to be compressed or extended by the plunger core 21 either when the plunger core 21 moves from the one end 22 of the solenoid 20 toward the middle portion of the solenoid 20, and/or from the middle portion toward the other end 23 of the solenoid 20, and/or when the plunger core 21 moves out of the other end 23 of the solenoid 20. Similarly, the spring member 14 may also be arranged to be pulled by the plunger core 21 to accumulate the spring biasing force against the plunger core 21.

The prior electric percussion tools fail to provide a single solenoid 20 and a spring member 14 to act simultaneously onto the plunger core 21 and to apply both the electromagnetic action of the solenoid 20 and the spring biasing force of the spring member 14 to force the shank 25 of the plunger core 21 to impact or to hit or to hammer onto the objects.

However, two or more solenoids 20 may also be provided to act or actuate the plunger core 21, and to draw the plunger core 21, from either end of the solenoids 20 to the middle portion of the solenoids 20. The spring member 14 may also be used to be compressed by the plunger core 21 and to accumulate the spring biasing force to force the plunger core 21 to move in the driving or acting direction toward the one end of the solenoids 20 in addition to the electromagnetic action by the two or more solenoids 20. Alternatively, the spring member 14 may be disposed and arranged to be coupled to the plunger core 21 and to apply a pulling force against the plunger core 21.

Accordingly, the method for driving electric percussion tools may be used for allowing the spring member to apply a moving or driving force against the plunger core, in addition to a solenoid, while conducting the striking or hammering operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for driving an electric percussion tool, said electric percussion tool including a solenoid having a first end and a second end and a middle portion, a plunger core partially engaged in said first end of said solenoid, and a spring member, said method comprising:

energizing said solenoid to draw said plunger core from said first end of said solenoid toward said middle portion of said solenoid, de-energizing said solenoid, to allow said plunger core to move from said middle portion of said solenoid toward said second end of said solenoid with a moment of inertia of said plunger core, applying a spring biasing force of said spring member against said plunger core to force said plunger core to move partially into said second end of said solenoid, and energizing said solenoid again to draw said plunger core from said second end of said solenoid toward said middle portion of said solenoid, and to allow said plunger core to move from said middle portion of said solenoid toward said first end of said solenoid with a moment of inertia of said plunger core.

2. The method for driving electric percussion tools as claimed in claim 1 further comprising de-energizing said solenoid again, to allow said plunger core to move from said middle portion of said solenoid toward said first end of said solenoid with a moment of inertia of said plunger core.

3. The method for driving electric percussion tools as claimed in claim 1 further comprising spacing said spring member away from said solenoid to allow said plunger core to move outwardly beyond said second end of said solenoid when said plunger core is forced against said spring member.

4. The method for driving electric percussion tools as claimed in claim 3 wherein said solenoid is energized again to draw said plunger core from said second end of said solenoid toward said middle portion of said solenoid when said plunger core is forced to move partially into said second end of said solenoid by said spring member.

* * * * *